United States Patent [19]

Rutens

[11] Patent Number: 4,619,005

[45] Date of Patent: Oct. 28, 1986

[54] WATERBED, SOFA AND TABLE

[76] Inventor: Imants R. Rutens, 8853 Valley Circle Dr., Florence, Ky. 41042

[21] Appl. No.: 726,427

[22] Filed: Apr. 24, 1985

[51] Int. Cl.[4] ..... A47C 27/08

[52] U.S. Cl. ..... 5/2 R; 5/12 R; 5/56; 297/174; 297/217

[58] Field of Search ..... 5/2 R, 3–6, 5/52, 53 R, 59 R, 59 B, 59 C, 12 R, 56, 503; 297/135, 174, 217

[56] References Cited

U.S. PATENT DOCUMENTS

| | | | |
|---|---|---|---|
| 491,080 | 2/1893 | Conant . | |
| 1,812,298 | 6/1931 | Kimble | 5/56 X |
| 1,824,156 | 9/1931 | Kimble | 5/503 X |
| 2,412,005 | 12/1946 | Parsons | 5/2 R |
| 2,436,546 | 2/1948 | Binenkorb . | |
| 2,532,355 | 12/1950 | Brown . | |
| 2,690,570 | 10/1954 | Salisbury | 5/2 R |
| 2,720,659 | 10/1955 | Brown . | |
| 3,319,269 | 5/1967 | Maddox . | |
| 3,346,889 | 10/1967 | Gran . | |
| 4,180,878 | 1/1980 | Howell . | |

FOREIGN PATENT DOCUMENTS

| | | | |
|---|---|---|---|
| 680716 | 2/1964 | Canada | 5/2 R |
| 2395001 | 2/1979 | France | 5/2 R |
| 582035 | 9/1958 | Italy | 5/2 R |

*Primary Examiner*—John E. Murtagh
*Assistant Examiner*—Richard E. Chilcot, Jr.
*Attorney, Agent, or Firm*—Wood, Herron & Evans

[57] ABSTRACT

A combined waterbed, sofa and sofa table includes a waterbed frame, a sofa mounted on the frame and covering a portion of the waterbed, and a foldable table secured over another portion of the waterbed adjacent the back support of the sofa. The sofa can be removed from the waterbed frame and the table pivoted away from the waterbed to provide full access thereto. In another configuration, the sofa can be removed and reversed on the frame so that the seat of the sofa faces the table, with the waterbed providing a soft underfooting for persons seated on the sofa at the table. Accordingly, waterbed, sofa and table functions are provided, together or separately, in a single furniture unit.

12 Claims, 4 Drawing Figures

WATERBED, SOFA AND TABLE

This invention relates to furniture and more particularly to waterbeds.

Waterbeds have become increasingly popular in view of their comfort features which are well known. While useful for all ages, such beds have particular appeal to younger people. Nevertheless, the expense of such beds may render them unattainable by young people in certain economic situations, where other furniture must be purchased as well. Also, many people may not have sufficient space to house a double size bed in addition to other furniture in cramped living quarters.

The combination of furniture functions in a single unit to provide various uses and reduce expense is generally known. For example, the well known "sleeper" sofa can be converted from a sofa to a bed. Such units generally require the removal of a portion of a sofa's cushions, and the unfolding of a bed frame and mattress. Other devices have provided a bed by folding up a sofa unit attached thereto to expose the bed. In such known devices, the sofa function is generally rendered non-usable when the bed structure is exposed or presented for use.

A waterbed, however, contains liquid and is heavy. There is no known way to fold up the filled waterbed bladder, as a more conventional mattress may be folded, so that it can be unfolded for immediate use. Moreover, there is no known way to provide multiple furniture functions in a waterbed unit so as to completely uncover the entire bed and frame for unobstructed use. Known waterbeds thus generally provide only single function use, i.e., as a waterbed.

Accordingly, it has been one objective of this invention to provide improved furniture including a combined waterbed, sofa and table.

A further objective of the invention has been to provide a combined waterbed, sofa and table unit having variable structural positions to provide different furniture functions.

A further objective of the invention has been to provide a combined furniture unit having waterbed, sofa and table functions all within the general vertical confines of the waterbed.

A further objective of the invention has been to provide a combined furniture unit having sofa, table and waterbed components wherein the waterbed and sofa components can be used separately and independently, or combined to provide a sofa and table combination over the waterbed, with the table either behind, or in front of, the sofa.

To these ends, a preferred embodiment of the invention includes a combined waterbed, sofa and table wherein the sofa is removably and reversibly mounted over the waterbed, and the table is hinged to cover a portion of the waterbed not covered by the sofa, or to pivot away from the bed to permit full access to the bed when the sofa is removed. A bed frame defines a bed area and includes two parallel elongated side members and two parallel end members therebetween. A sofa is removably and reversibly mounted on one side and two end members, with the seat facing outwardly of the side member. The table has a table top with two depending end members and a back member extending above the other side frame member of the bed. The top is hinged to the back member in a normal horizontal position, with one edge proximate the sofa back.

The sofa can be lifted from the frame, and the table top pivoted upwardly to lie in the same vertical plane as the table back member, thereby completely uncovering the waterbed for use. The table ends are pivoted against the vertical table top so they too are out of the way.

Alternately, the sofa can be reversed on the end members such that the seat faces the table as it covers a portion of the bed. In this way, the sofa provides a seat for use at the horizontal table, with the waterbed providing a soft underfooting.

Of course, the sofa can be used separately from the bed. To this end, the sofa can be simply supported on the floor, or fold down legs can be provided.

Accordingly, the invention provides a combined sofa, waterbed and sofa table in a single unit, wherein the bed can be used independently of the sofa and of the table. The three components can be combined to provide a sofa and sofa table, completely obscuring the waterbed, or the waterbed and sofa can be separated and used separately. The fold up table can be provided with appropriate decoration for use as a table, and for use as a decorative display area when folded up to the vertical, presenting a vertical display surface not generally visible when the table is in use.

The invention thus provides a multifunctional combined furniture system with many variations of configurations, use and space saving features.

These and other objectives and advantages will become readily apparent from the following detailed description of a preferred embodiment of the invention, and from the drawings in which.

Figure 1:
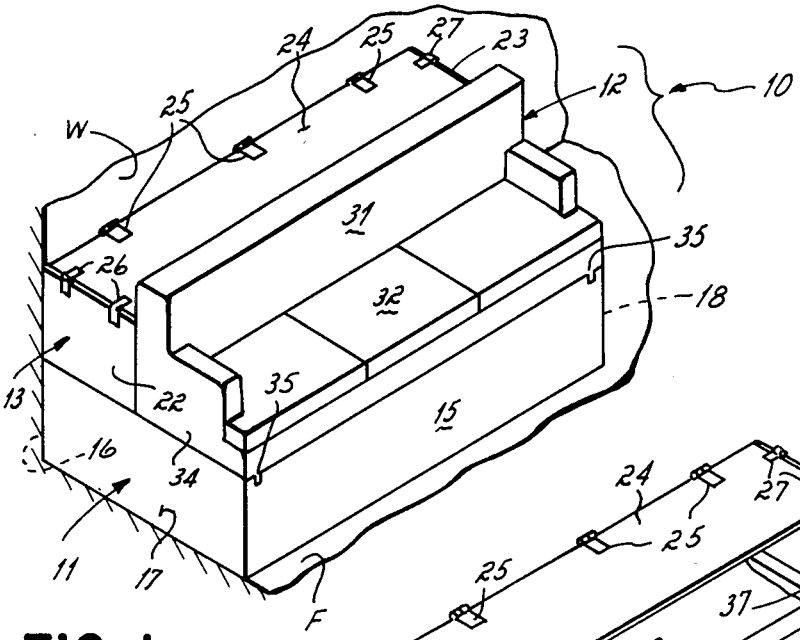
FIG. 1 is a diagrammatic perspective view of the invention.
Figure 3:
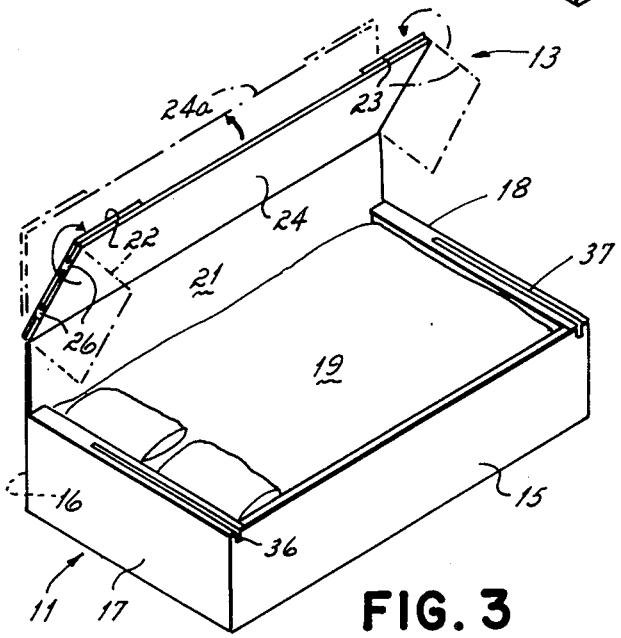
FIG. 3 is a diagrammatic perspective view of the invention similar to FIG. 1, but with the sofa removed and the table lifted vertically to clear the waterbed for use.

Turning now to the drawings, there is shown in FIG. 1 a perspective view of the invention in a first position wherein a combined sofa, sofa table and waterbed 10 are disposed on a floor F and against a vertical wall W. The combined waterbed, sofa and sofa table 10 comprise a waterbed 11, a sofa 12 and a sofa table 13. The waterbed 11 is comprised preferably of a waterbed frame having elongated, preferably parallel side frame members 15 and 16 and elongated, preferably parallel end frame members 17 and 18 (FIG. 3). The frame comprised of members 15 through 18 surrounds and defines a bed area containing a liquid filled bladder 19 and, in combination with such bladder 19, provides a waterbed 11. Liquid filled bladder 19 may be of any suitable well-known form and can be heated, damped with baffling, etc.

The sofa table 13 includes a table back member 21, table end members 22 and 23, and a table top member 24. As shown in FIGS. 1 and 3, the table back member 21 extends upwardly and in the same plane as the elongated side frame member 16 of the waterbed. Alternately, back member 21 and side frame member 16 can be made of one integral piece. Further, back member 21 could be removably attached or hinged to side frame 16.

Figure 2:
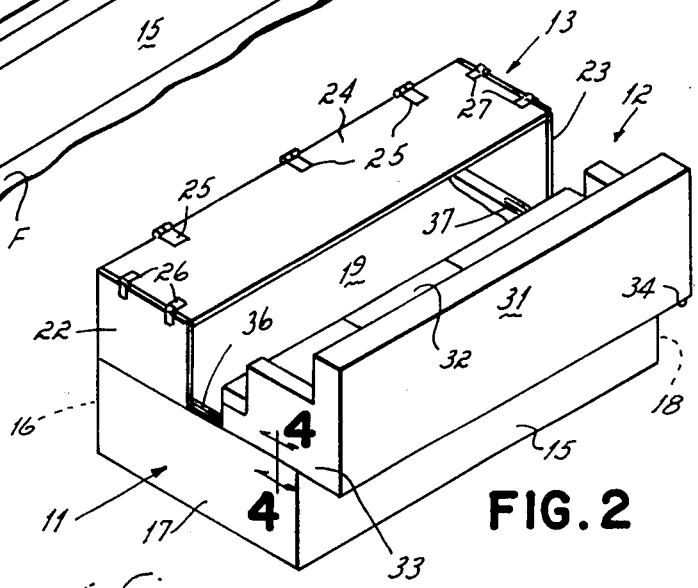
FIG. 2 is a perspective view of the invention similar to FIG. 1, but with the sofa reversed.

The table top member 24 is movably attached to the table back member 21, such as by means of the hinges 25, so that top 24 is normally horizontal with back member 21 depending vertically therefrom. The table end members 22 and 23 are movably connected to the table top 24 by means of the respective hinges 26 and 27, and normally depend vertically therefrom to rest on portions of respective frame members 17, 18. In use, it will be appreciated that while the table top 24 is normally in a horizontal position, as shown in FIGS. 1 and 2, it can be pivoted to a vertical position as shown by the dotted lines 24*a* in FIG. 3. Also, it will be appreciated that the table end members 22 and 23 normally depend perpendicularly and vertically from the top 24, also as shown in FIGS. 1 and 2, but can be pivoted from their dotted line vertical position (see arrows (FIG. 3), flat against the table top when the table top is moved to its vertical position 24a. This maneuver, when the sofa 12 is removed from the waterbed 11, completely uncovers the bed area of the waterbed 11 for use as shown in FIG. 3.

Sofa 12 includes a back support 31 and a seat 32, facing outwardly of the elongated side frame member 15, as shown in FIG. 1. Sofa 12 can be reversed on the waterbed 11, such that the seat 32 faces in the opposite direction and toward the area covered by the table top 24. In this condition, the sofa 12, waterbed 11 and table unit 13 can be utilized as a seating arrangement with the waterbed bladder 19 providing a soft underfooting for persons seated on the sofa. Moreover, it will be appreciated that in this condition the back support 31 is generally located over the elongated side frame member 15 or slightly outwardly thereof in order to provide for ingress and egress to the sofa.

Figure 4:
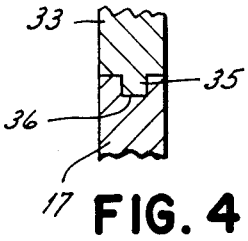
FIG. 4 is a cross-section view taken along lines 4—4 of FIG. 2.

In this connection, it will be appreciated that the sofa has lower frame portions 33 and 34 (FIG. 4) which are provided with elongated tongue members 35, while the end frame members 17 and 18 of the waterbed 11 are provided with elongated grooves 36 and 37, respectively. These cooperating tongue and groove elements on each of the sofa and the waterbed frame provide means for removably and reversibly mounting the sofa thereto.

For example, as shown in FIG. 1, the tongues 35 on each end of the sofa are fitted into the respective grooves on the end members 17, 18 of the waterbed frame so that the sofa can be easily removed therefrom, or reversed and mounted thereon as shown in FIG. 2. Alternatively, the sofa 12 can be merely set on the floor F in a different position and away from the waterbed 11 when the waterbed is to be used, thus providing both waterbed and sofa functions in two separate pieces of furniture.

Of course, it will be appreciated that many different types of fasteners, brackets, latches, hinges, or other hardware or jointery could be utilized in the invention to provide differing movements. For example, the table top 24 could be attached to the table back member 21 in a variety of different ways, permitting the top to be moved out of the way when it is desired to use the waterbed 11. Likewise, the table end members, which are normally in a perpendicular position supported on the end frame members 17 and 18, as shown in FIGS. 1 and 2, can be attached to the table top or to the table back member 21 in any number of different types of ways.

It should also be noted that the sofa 12 can be mounted to the waterbed 11 in a variety of different ways, such as by means of varying brackets, mounting assemblies, and the like, in order to provide differing functions. For example, if it is not desired to provide a removable sofa or a reversible sofa feature, the front end of the sofa could simply be hinged to the waterbed frame such as the elongated side 15 to provide for pivoting the sofa from over the waterbed.

Also, it will be appreciated that appropriate latch members could be provided for releasably securing the table 13 and the sofa 12 with respect to the waterbed 11, so that they cannot be inadvertently moved.

Several other aspects of the invention are readily appreciated from the foregoing description. For example, it will be appreciated that the table top 24 is disposed in a plane which is above the plane of the sofa seat 32, with respect to the waterbed bladder 19. In other words, the table top 24 and the seat 32 are arranged so that when the elements of the invention are configured as in FIG. 2, a person may seat himself on the sofa with his legs extending under the table top 24.

It will also be appreciated that the waterbed frame comprising side members 15, 16 and end members 17 and 18 define a bed area which is filled by the bladder 19. As such, it will be appreciated that the sofa 12 covers a first portion of the bed area which is defined by the various frame members, while the table top as in FIG. 1 covers a second portion of the bed area, with the table top 24 lying in a horizontal position and proximate the back support 31 of the sofa.

Preferably, the waterbed, sofa and sofa table 10 may be mounted on the floor F and against a wall W as shown in FIG. 1. Alternatively, of course, the unit could be mounted away from a wall. In this configuration, the table top 24 may be hinged over rearwardly from its position as shown in FIG. 1 through 270°, where it would lie parallel to the back member 21 and completely out of the way. Alternatively, top 24 and/or member 21 could be mounted so as to be altogether removable.

It will also be appreciated that the underside of the table top 24, as well as the outwardly facing side of the back member 21, can be provided with decorative indicia or other accoutrements to provide a decorative or aesthetic display surface when the table top is unfolded to the vertical position, such as that shown in FIG. 3.

Finally, it will be appreciated that other means could be provided for mounting the sofa 12 on the waterbed 11. For example, in place of the tongue and groove mounting means as described, the tongue could be constructed of a dovetail configuration with the groove being also tapered, so as to prevent rotation of the sofa when it is used, for example, in the configuration as shown in FIG. 2. Alternatively, various latches could be provided to prevent any undesirable movement of the sofa with respect to the waterbed.

These and other modifications will become readily appreciated by those of ordinary skill in the art without departing from the scope of this invention and applicant intends to be bound only by the claims appended hereto.

I claim:

1. A modular furniture system comprising:

a waterbed having a frame including elongated side and end members defining a bed area, and a flexible bladder means for containing water within said bed area surrounded by said frame;

a sofa mounted on said waterbed frame;

said sofa comprising a seat member and back member fixed to each other in an attitude permitting sitting thereon;

mounting element means for removably mounting said sofa over said waterbed frame;

said seat and back members remaining in said fixed attitude when said sofa is removed from over said frame;

said sofa extending longitudinally along and over one of said elongated side members and portions of each of said elongated end members, such that a portion of the bed area surrounded by said frame is covered by said sofa and another portion of said bed area is uncovered by said sofa; and a table means disposed rearwardly of said sofa and for removably covering said other portion of said bed area.

2. A modular furniture system as in claim 1, wherein said table means is hinged to said frame and includes a hinged top, and two end portions hinged to said top at respective ends of said top, said top and end portions in one position enclosing said other portion of said bed area and, in another position, uncovering said other portion of said bed area to permit full access to said entire bed area for use as a waterbed when said sofa is removed from said waterbed frame.

3. A modular furniture system as in claim 2, wherein said hinged top is hinged for movement to a vertical position over one of said elongated side frame members, said hinged end portions being hinged for movement to a position parallel to said hinged top.

4. A modular furniture system comprising:

a waterbed having a frame including elongated side and end members defining a bed area, and a flexible bladder means for containing water within said bed area surrounded by said frame;

a sofa mounted on said waterbed frame;

mounting element means for mounting said sofa to said waterbed frame;

said sofa extending longitudinally along and over one of said elongated side members and portions of each of said elongated end members, such that a portion of the bed area surrounded by said frame is covered by said sofa and another portion of said bed area is uncovered by said sofa; and a table means disposed rearwardly of said sofa and for removably covering said other portion of said bed area;

wherein said sofa is reversible on said waterbed frame.

5. A modular furniture system as in claim 4, wherein said sofa has a back support and a seat and wherein said sofa is mountable to said frame in one position with said back proximate said table means, and said seat facing outwardly of said frame, and in another reverse position with said back support disposed generally above one of said frame side members and said seat facing said table means over said bed area surrounded by said frame.

6. In combination, a waterbed, a sofa and a sofa table, the combination further comprising:

a waterbed frame having elongated side and end members extending around the waterbed and defining a bed area for a liquid bladder within said frame;

a sofa having a back support and a seat, said sofa removably and reversibly disposed on said frame over a first portion of said bed area; and said sofa table being removably disposed over a second portion of said bed area.

7. The combination of claim 6, wherein said sofa table has a table surface, wherein said sofa, in one position, has said back support extending over said first portion of said bed area between respective end members of said frame with said back support proximate said sofa table, and wherein said sofa, in a reversed position, has said back support extending approximately over one of said side members of said frame, with said seat facing said sofa table, said sofa table surface lying in a plane above the plane of said sofa seat, relative to said bed area.

8. The combination of claim 6, further including table ends depending perpendicularly from said table and a table back perpendicular to said table, said table being movably attached to said table back for movement to a position removed from over said bed area.

9. The combination of claim 8, wherein said table ends are movably attached to said table for movement thereagainst when said table is removed from over said bed area.

10. The combination of claim 7, further including mounting means on each of said frame and said sofa for cooperating together to mount said sofa on said frame in either one of a first position and a second reversed position.

11. The combination of claim 10, wherein said mounting means comprises elongated grooves on one of said frame end members and the ends of said sofa and aid grooves corresponding to elongated tongue members on the other of said frame members and said sofa ends.

12. The combination of claim 10, further including elongated grooves in the respective end members of said waterbed frame and elongated tongue members on lower portions of said sofa for cooperating with said grooves to reversibly and removably mount said sofa to said frame.

* * * * *